United States Patent [19]

Fisher et al.

[11] Patent Number: 5,033,531

[45] Date of Patent: Jul. 23, 1991

[54] CASTING OF MOLTEN IRON AND FILTERS FOR USE THEREIN

[75] Inventors: Charles Fisher, Strongsville; Hugh Kind, Rocky River; James Devine, Sheffield Lake, all of Ohio; Michael J. Gough, Gnosall, near Stafford; Ian N. Delaney, Tamworth, both of England

[73] Assignee: Foseco International Limited, Birmingham, England

[21] Appl. No.: 553,577

[22] Filed: Jul. 18, 1990

[30] Foreign Application Priority Data

Jul. 26, 1989 [GB] United Kingdom ..... 8917072
Jun. 14, 1990 [GB] United Kingdom ..... 9013253

[51] Int. Cl.[5] ..... B22C 9/08; B22D 1/00; B22D 27/20

[52] U.S. Cl. ..... 164/57.1; 164/134; 164/358; 210/209; 210/496; 210/510.1

[58] Field of Search ..... 164/57.1, 58.1, 56.1, 164/55.1, 134, 358, 362; 210/510.1, 496, 209, 490

[56] References Cited

U.S. PATENT DOCUMENTS

| | | | |
|---|---|---|---|
| 3,658,115 | 4/1972 | Ryntz, Jr. et al. | 164/57.1 |
| 4,955,427 | 9/1990 | Hitchings | 164/358 |

FOREIGN PATENT DOCUMENTS

| | | | |
|---|---|---|---|
| 0234825 | 9/1987 | European Pat. Off. . | |
| 0249897 | 12/1987 | European Pat. Off. | 164/58.1 |
| 1608051 | 10/1970 | Fed. Rep. of Germany . | |
| 2608282 | 9/1977 | Fed. Rep. of Germany . | |
| 2242466 | 3/1975 | France . | |
| 61-216840 | 9/1986 | Japan | 164/57.1 |
| 61-229462 | 10/1986 | Japan | 164/57.1 |
| 62-21458 | 1/1987 | Japan | 164/134 |
| 62-244549 | 10/1987 | Japan | 164/134 |
| 62-244550 | 10/1987 | Japan | 164/58.1 |
| WO82/03339 | 10/1982 | PCT Int'l Appl. . | |
| 916784 | 1/1963 | United Kingdom . | |
| 923862 | 4/1963 | United Kingdom . | |
| 1004352 | 9/1965 | United Kingdom . | |
| 1054421 | 1/1967 | United Kingdom . | |
| 1105028 | 3/1968 | United Kingdom . | |
| 1257168 | 12/1971 | United Kingdom . | |
| 1377691 | 12/1974 | United Kingdom . | |
| 1388911 | 3/1975 | United Kingdom . | |
| 1388912 | 3/1975 | United Kingdom . | |
| 1388913 | 3/1975 | United Kingdom . | |
| 1448058 | 9/1976 | United Kingdom . | |
| 1542358 | 3/1979 | United Kingdom . | |
| 15423859 | 3/1979 | United Kingdom . | |
| 2034298A | 6/1980 | United Kingdom . | |
| 2062609A | 5/1981 | United Kingdom . | |
| 2166758A | 5/1986 | United Kingdom . | |

OTHER PUBLICATIONS

Abstract of Japanese Patent Publication 56-136251 published Oct. 24, 1981.

Abstract of Japanese Patent Publication 56-060618, May 25, 1981.

English Translation of Japanese Patent Publication 57-140381, Aug. 30, 1982.

Abstract of Japanese Patent Publication 59-190248A, Oct. 29, 1984.

*Primary Examiner*—J. Reed Batten, Jr.
*Attorney, Agent, or Firm*—Nixon & Vanderhye

[57] ABSTRACT

Molten iron is cast into a mould through a filter located in the runner system of the mould using a filter comprising a body having a plurality of cells, at least some of the cells having their walls at least partially coated with a first layer of wax and a second layer of an inoculant, such as graphite, calcium silicide or ferrosilicon, for the iron.

14 Claims, 2 Drawing Sheets

CASTING OF MOLTEN IRON AND FILTERS FOR USE THEREIN

This invention relates to the casting of molten iron in a mould and to filters for use therein.

When molten iron is treated with an inoculant prior to casting there is a tendency for the effect of the inoculant to be diminished, (known as "fading"), before the metal is cast into moulds. Various methods have therefore been proposed for inoculating molten iron as late as possible in the casting process, either by treating the iron just before it enters the mould or by treating the iron in the mould itself.

An inoculant for iron is a substance which when added to molten iron will form nuclei for crystallisation when the iron solidifies on casting. By creating favourable conditions for solidification the inoculant controls the graphite structure or morphology, eliminates or reduces the formation of iron carbides known as chill, increases the eutectic cell or nodule count, reduces casting section sensitivity and prevents undercooling.

Inoculation in the mould involves placing the inoculant at a point in the runner system, preferably as near to the mould cavity as possible, so that the molten iron is treated as it flows through the runner system.

Attempts have been made to utilise an inoculant in the form of fine particles, for example fine particles of ferrosilicon for inoculating grey cast iron or spheroidal graphite iron, but they have not been successful because the particles of inoculant tend to get washed into the mould cavity where they can form inclusions in the casting produced when the molten iron solidifies, and because there is a tendency for castings having variations in their microstructure to be produced.

In order to overcome the problems associated with the use of fine particles methods have been proposed which utilise inserts made of bonded, compressed or sintered particulate inoculants, over which or through which the molten iron flows and in one such method the insert rests on a strainer core. However, none of these methods has been wholly successful and none has achieved wide commercial use. Cast inserts have also been used but because they tend to shatter under the influence of thermal shock they can give rise to inclusions in the castings.

When casting molten iron into moulds it is often desirable to include in the mould some means for preventing inclusions from being incorporated in castings produced in the moulds.

With grey and malleable irons inclusions can be formed due to refractory particles and/or slag being carried over from a furnace or a ladle into the mould cavity or due to particles of sand from the runner system of a sand mould being washed into the mould cavity.

Inclusions are most prevalent in ductile or nodular irons because in addition sticky magnesium silicate slags, often associated with particles of magnesium oxide and magnesium sulphide, are formed during the nodularising process and these are difficult to remove prior to pouring the molten metal into the mould, even through special precautions such as a fluxing treatment, the use of a teapot ladle or the use of a specially designed runner system incorporating slag traps are adopted.

Strainer cores are often used in moulds in malleable and grey iron foundries, but their principal function is as a means for controlling the flow of molten iron into the mould and they have only a limited filtering effect.

In recent years it has become common practice to incorporate cellular ceramic filters in moulds for casting ferrous metals. European Patent Application Publication 0234825 describes a process for casting molten ferrous metal in a mould in which molten ferrous metal is poured into a mould having a ceramic filter having an open-cell foam structure located in the runner of the mould, and a sealed plastics container containing particles of a treatment agent for the molten ferrous metal located in a chamber in the runner system on that side of the filter which is further from the mould cavity, such that part of the container is in the sprue well, so that molten ferrous metal is treated by the treatment agent before flowing through the filter and into the mould cavity.

According to the present invention, there is provided a process for casting molten iron in a mould comprising providing a mould having a mould cavity and a runner system, locating in the runner system a filter having a plurality of cells, at least some of the cells having their walls at least partially coated with an inoculant for the iron, and pouring molten iron into the mould so that the iron passes through the filter and into the mould cavity.

According to a further feature of the invention there is provided a filter for filtering molten iron comprising a body having a plurality of cells, at least at some of the cells having their walls at least partially coated with an inoculant for the molten iron.

The body forming the filter may be for example a ceramic body having a honeycomb type of structure having cells extending between opposite faces of the body, a porous pressed ceramic body, or an open-cell ceramic foam. An open-cell ceramic foam is preferred.

Ceramic honeycomb structured bodies can be made by extruding material through a die having an outlet face provided with a gridwork of interconnected discharge slots and an inlet face provided with a plurality of feed openings extending partially through the die in communication with the discharge slots and drying and firing the honeycomb structure so-formed. The production of ceramic honeycomb structures by such a method is described in U.S. Pat. No. 3790654.

Open-cell ceramic foams which are suitable for use as filters for molten ferrous metals may conveniently be made by impregnating an organic foam, such as recticulated polyurethane foam, with an aqueous slurry of ceramic material containing a binder, drying the impregnated foam to remove water and then firing the dried impregnated foam to burn off the organic foam to produce a ceramic foam replica. The production of ceramic foams by such a method is described in U.S. Pat. No. 3,090,094, in British Patents 923862, 916784, 1004352, 1054421, 1377691, 1388911, 1388912 and 1388913 and in European Patent Application Publication 0074978.

The material used for the ceramic filter must withstand the temperature of and be resistant to molten iron and suitable materials include alumina, high alumina content silicates such as sillimanite, mullite and burned fireclay, silicon carbide and mixtures thereof.

Examples of suitable inoculants are graphite, calcium silicide and ferrosilicon, usually containing 50–85% by weight silicon and small quantities of calcium and/or aluminium. Special types of ferrosilicon containing other elements such as titanium, chromium, zirconium, manganese, copper, bismuth, alkaline earths such as barium or strontium, or rare earths such as cerium, may also be used. If desired one or more of the elements listed above may be used in conjunction with an inoculant such as ferrosilicon and either mixed with the ferrosilicon and applied to the filter so as to constitute a single inoculant layer or applied to the filter on top of the ferrosilicon so as to constitute a second inoculant layer.

The size of the particles of inoculant may be up to about 10 mm but preferably particles having a narrow size range of less than 6 mm, more preferably 0.05 mm–2 mm, are used. Relatively large particles tend to produce slower fading of the inoculation effect because they dissolve in the molten iron relatively slowly but they may produce insufficient nucleation sites. Relatively small particles produce sufficient nucleation sites but because they dissolve faster they tend to produce more rapid fading.

The cells of the filter may be coated with the inoculant by a variety of techniques such as plasma spraying, coating using a dispersion of particulate inoculant in a suitable medium or preferably by coating with a first layer of an adhesive and a second layer of particulate inoculant.

When a dispersion of inoculant is used particles of the inoculant may be dispersed in water or in an organic carrier liquid, containing a binder, and the dispersion can be applied as a coating to the cell walls of the cellular body by, for example, spraying or dipping the body in the dispersion. After the coating has been applied it is dried to remove the water or organic carrier liquid.

Alternatively the particles of treatment agent may be dispersed in a medium of wax or a substance having a physical characteristics of wax. The use of such dispersions in the treatment of molten ferrous metals is described in British Patents 1105028 and 1257168 and suitable media include natural waxes such as beeswax, carnauba wax or montan wax, paraffin wax, fatty acids such as stearic acid and fatty acid esters such as stearates. The particles of treatment agent are added to the medium which has been heated so that it is liquid and are dispersed, and the dispersion is then applied to the cell walls of the cellular body by for example, spraying, pouring or by dipping the cellular body in the dispersion. After application the dispersion is allowed to cool and an adherent coating of the inoculant is obtained.

In the preferred embodiment in which the cell walls are first coated with an adhesive, the adhesive may be any type of adhesive which will remain tacky after application to the cell walls of the filter. The adhesive may be for example a wax or a substance having the physical characteristics of a wax such as the materials listed above. Such adhesives may be applied to the filter by heating the adhesive until it is liquid and then spraying it into the filter or dipping the filter into the liquid adhesive and draining off excess adhesive. The adhesive may also be a resin such as an acrylic resin which can be applied to the filter in the form of a dispersion or a solution in a liquid medium such as water or an organic solvent by spraying or dipping and then drying to remove the liquid medium.

The inoculant particles may be applied to the adhesive-coated cell walls of the filter for example by dropping the particles through the filter under gravity or by blowing the particles into the filter using compressed air, and allowing excess inoculant to pass through the filter. The inoculant particles may also be applied to the filter by immersing an adhesive-coated filter in a fluidised bed of the inoculant particles.

If desired the particles of inoculant may be encapsulated in a material which will retard the dissolution rate of the inoculant in the molten ferrous metal.

The inoculant-coated filters of the invention may take a number of forms. For example the whole wall surface of all the cells may be coated, part only of some of the cell walls may be coated or some of the cells may be filled with inoculant throughout the whole or only part of the thickness of the filter. Depending on the form which it is desired to achieve, certain area of the cellular body may be masked when the inoculant is applied or the cellular body may be only partially immersed in the inoculant dispersion or precoating adhesive.

The thickness of the coating of inoculant may be controlled for example, by controlling the time the cellular body is immersed in the inoculant dispersion or by removing excess dispersion after application.

The pick-up of inoculant by the filter will be dependent on the surface area of the filter cell walls and on the particle size of the inoculant used. For example for a rectangular ceramic foam filter 75 mm long, 50 mm wide and 22 mm thick having 4 pores per linear cm and weighing 38–40 g the inoculant coating using an inoculant of particle size 0.2 mm–0.5 mm is 32–35 g. For a similar filter of 8 pores per linear cm the amount of inoculant coating using the same inoculant is 20–25 g.

In use the inoculant-coated filter is located in the runner system of a mould, preferably as near to the mould cavity as possible and molten iron metal is poured into the mould so that it flows through the filter in which the iron is inoculated and inclusions are removed from the iron before flowing into the mould cavity.

The filter of the invention offers the following advantages:

1) It enables the use of a single method of applying both a filter and an inoculant in a mould cavity.

2) It provides a substrate with a high surface area which permits rapid and uniform distribution of an inoculant in a metal stream and a reduction in the amount of inoculant required for effective treatment.

3) It eliminates the separate manufacturing operation needed to produce bonded or cast inoculants and the need to place such inoculants in the mould cavity.

4) Incorporation of an inoculant with a filter reduces casting inclusions caused by undissolved inoculant, oxidised inoculant or alloy slags.

5) The filter is adaptable to automatic placement in a mould thus reducing manpower requirements.

The following examples will serve to illustrate the invention:

EXAMPLE 1

Two test moulds in furfuryl alcohol modified phenol-formaldehyde resin bonded silica sand were produced as shown in the accompanying drawings in which FIG. 1 is a schematic vertical section of the mould FIG. 2 is a section along a—a of FIG. 1

Figure 1:
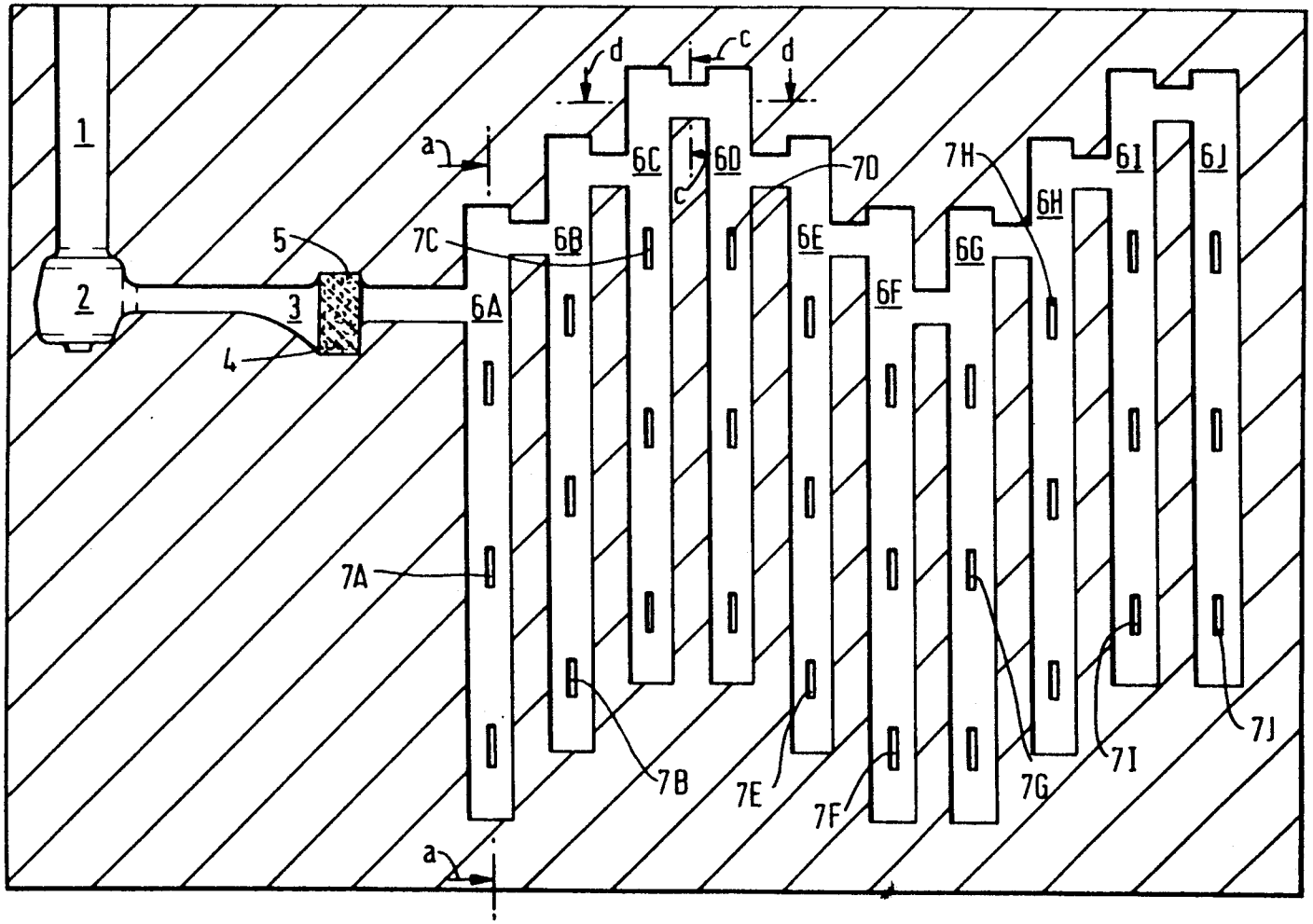
Figure 2:
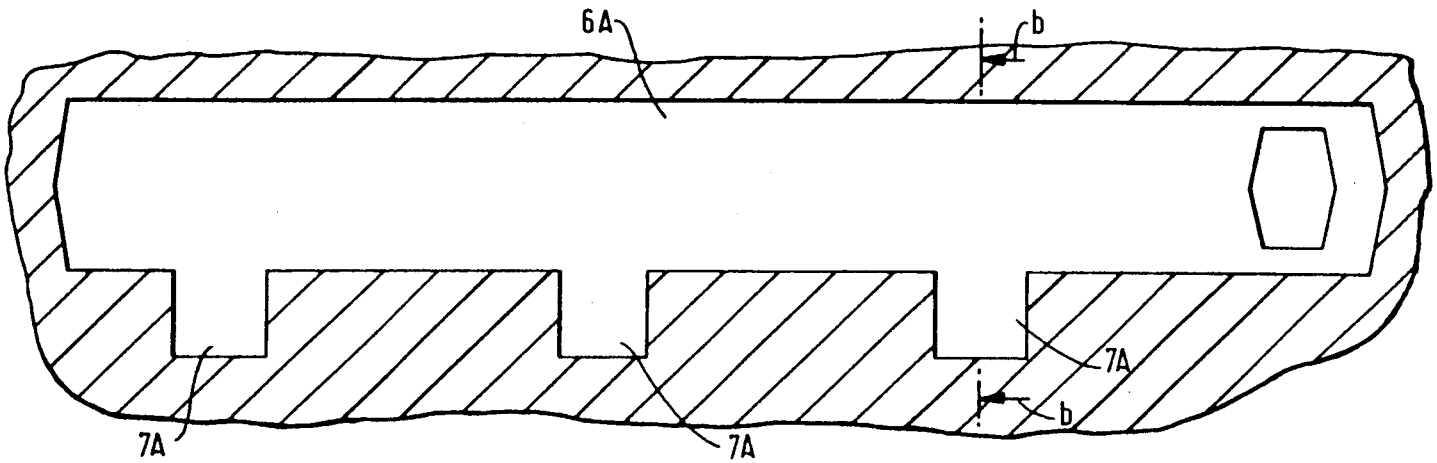
Figure 3:
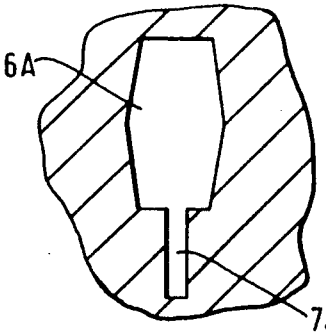
FIG. 3 is a section along b—b of FIG. 2
Figure 4:
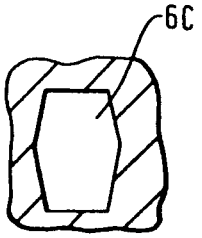
FIG. 4 is a section along c—c of FIG. 1.
Figure 5:
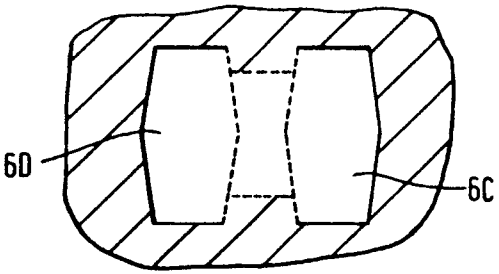
FIG. 5 is a section along d—d of FIG. 1.

Referring to the drawings the mould consists of a sprue 1, a sprue well 2, a runner 3, having a print 4 capable of accepting a 75 mm × 50 mm rectangular filter 5 of 22 mm thickness, and 10 vertical mould cavities 6A–6J to produce castings 1–10 interconnected so that when molten iron is poured into the mould and passes through the filter the vertical mould cavities 6A-6J fill sequentially. Each of the test bar mould cavities 6A-J is connected to three small cavities 7A-7J for producing chill pieces of cast iron. As each of the test bar cavities 6A-6J fill with molten iron so do the chill piece cavities 7A-7J and the iron in the chill piece cavities 7A-7J solidifies instantaneously.

A rectangular ceramic foam filter of silicon carbide, alumina and silica, and bonded by aluminium orthophosphate, having a size of 75 mm×50 mm×22 mm and 4 pores per linear cm was inserted into the print 4 of one of the moulds, and an inoculant-coated filter according to the invention was inserted into the print 4 of the other mould.

The filter used in the second mould was the same composition and size as the filter used in the first mould and its cell walls were coated with montan wax by dipping the filter in molten montan wax and then with inoculant by allowing particles of the inoculant to fall through the filter under gravity. The inoculant used had a nominal composition by weight of 65% silicon, 1.4% aluminium 1.4% calcium, 4.0% manganese, 3.75% zirconium and balance iron, and a particle size of 0.2 mm to 0.5 mm. The uncoated filter weighed 39.7 g and the amount of inoculant material carried by the filter after coating was 36.2 g.

A charge of refined pig iron and steel scrap was melted in a medium frequency induction furnace and heated at 1500° C. The molten iron was tapped into a clean pre-heated ladle containing a 2.9% by weight addition of magnesium-ferrosilicon (5% by weight magnesium) based on the weight of iron to produce spheroidal graphite iron. The iron was then inoculated by the addition of 0.4% by weight based on the weight of iron of foundry grade ferrosilicon.

The analysis of the treated iron was:
carbon—3.60%
silicon—2.30%
sulphur—0.005%
magnesium—0.054%
manganese—0.062%
phosphorus —0.023%.

The iron was poured from the ladle into the two moulds at a temperature of 1410°-1430° C. The castings produced each of which weighed 40 kg were allowed to solidify and cool, and after the sand had been removed from them the chill pieces were removed from each of the ten test bars.

The central chill pieces were sectioned at right angles to the fractured face along their length, and the cut face of one of the sections was prepared and examined microscopically in order to measure the nodule count (number of graphite nodules per mm²).

The results obtained for the nodule count of chill pieces taken from different test bars are recorded in Table 1 below.

TABLE 1

| TEST BAR No. | CASTING FROM MOULD WITH UNCOATED FILTER - NODULE COUNT PER MM² | CASTING FROM MOULD WITH INOCULANT COATED FILTER - NODULE COUNT PER MM² |
|---|---|---|
| 1 | 151 | 1048 |
| 2 | — | 551 |
| 3 | 192 | 443 |
| 4 | — | 320 |
| 5 | 185 | 310 |

TABLE 1-continued

| TEST BAR No. | CASTING FROM MOULD WITH UNCOATED FILTER - NODULE COUNT PER MM² | CASTING FROM MOULD WITH INOCULANT COATED FILTER - NODULE COUNT PER MM² |
|---|---|---|
| 7 | 180 | 324 |
| 9 | 177 | 291 |

Using the test mould shown in the drawings and described above highly effective inoculation will produce a high nodule count in the chill pieces from all ten of the test bars. As the effectiveness of inoculation decrease so the nodule count decreases and fewer of the test bars. As the effectiveness of inoculation decrease so the nodule count decreases and fewer of the bars contain acceptable nodule numbers. Hence it is possible to assess the effectiveness of in-mould inoculation by estimating in terms of test bar number the point at which effective inoculation ends. In the present tests the filter coated with inoculant gave a higher nodule count for all the test bars compared to the nodule count of the test bars of the casting produced without inoculation in the mould.

EXAMPLE 2

Two moulds as shown in the drawings and the procedure described in Example 1 were used to determine the effectiveness of a filter coated with a mixture of ferrosilicon and copper as an in - mould inoculant.

One mould contained a ceramic foam filter of the type used in Example 1 and the other contained a similar ceramic foam filter which had been coated with montan wax and then with a mixture of 80% by weight of the inoculant used in Example 1 and 20% by weight copper powder of 99% purity and 0.5-1 mm particle size. The uncoated filter weighed 39.5 g and the amount of inoculant material carried by the filter after coating was 32.7 g.

Molten spheroidal graphite iron which had not been inoculated was poured from a ladle into the moulds at a temperature of 1410-1430° C. The analysis of the iron was:
carbon—3.50%
silicon—2.26%
sulphur—0.008%
magnesium—0.032%
manganese—0.089%
phosphorus—0.022%.

Chill pieces from the resultant casting were prepared as described in Example 1 and their nodule count determined. The results obtained for the central chill pieces from different test bars are tabulated in Table 2 below.

TABLE 2

| TEST BAR No. | CASTING FROM MOULD WITH UNCOATED FILTER - NODULE COUNT PER MM² | CASTING FROM MOULD WITH INOCULANT COATED FILTER - NODULE COUNT PER MM² |
|---|---|---|
| 1 | 146 | 841 |
| 2 | — | 718 |
| 3 | 181 | 400 |
| 4 | — | 335 |
| 5 | 176 | 223 |
| 7 | 222 | 323 |
| 9 | 208 | 248 |

As the results show the filter coated with inoculant gave a higher nodule counter for all the test bars compared to the nodule count of the test bars of the casting produced without inoculation in the mould.

EXAMPLE 3

Two test moulds in phenol-formaldehyde resin bonded silica sand were produced as shown in the accompanying drawings except that the print 4 was dimensioned so as to accept a 55 mm×55 mm square filter of 12 mm thickness.

A cordierite/mullite extruded ceramic filter having 40 cells per $cm^2$ was inserted into the print of one of the moulds, and an inoculant coated filter according to the invention was inserted into the print of the other mould.

The filter used in the second mould was the same composition as the filter used in the first mould and its cell walls were coated by dipping the filter into a dispersion consisting of 75% by weight ferrosilicon in 25% by weight paraffin wax. The ferrosilicon used had a nominal composition of 75% silicon, 0.3–1.0% calcium, 1.5–2.0% aluminium and balance iron, and a particle size of less then 75 microns. The uncoated filter weighed 23.1 g and the amount of inoculant and wax carried by the coated filter was 20.7 g.

A charge of refined pig iron and steel scrap was melted in a medium frequency induction furnace and heated to 1500° C. The molten iron was tapped into a clean pre-heated ladle containing a 2.9% by weight addition of magnesium-ferrosilicon (5% by weight magnesium) based on the weight of iron to produce spheroidal graphite iron. The iron was then inoculated by the addition of 0.4% by weight based on the weight of iron of foundry grade ferrosilicon.

The analysis of the iron was:
carbon—3.61%
silicon—2.45%
sulphur—0.005%
magnesium—0.041%
manganese—0.062%
phosphorus—0.021%.

The iron was poured from the ladle into the two moulds at a temperature of 1410–1430° C. Chill pieces from the resultant castings were prepared as described in Example 1 and their nodule count determined. The results for the central chill pieces from different test bars are tabulated in Table 3 below.

TABLE 3

| TEST BAR No. | CASTING FROM MOULD WITH UNCOATED FILTER - NODULE COUNT PER $MM^2$ | CASTING FROM MOULD WITH INOCULANT COATED FILTER - NODULE COUNT PER $MM^2$ |
|---|---|---|
| 1 | 113 | 131 |
| 3 | 131 | 163 |
| 5 | 164 | 184 |
| 7 | 137 | 170 |
| 9 | 122 | 160 |

The filter coated with inoculant gave a higher nodule count for all the test bars compared to the nodule count of the test bars of the casting produced without inoculation in the mould.

We claim:

1. A process for casting molten iron in a mould having a cavity and a runner system, and utilizing an open-cell ceramic foam filter, comprising the steps of:

at least partially coating at least some of the cells of the open-cell ceramic foam filter with a first layer of adhesive selected from the group consisting essentially of wax and substances having the physical characteristics of wax; and then applying a second layer of an inoculant for molten iron on top of the adhesive layer;

locating the coated open-cell ceramic foam filter in the runner system of the mould; and pouring molten iron into the mould so that the iron passes through the filter into the mould cavity.

2. A process as recited in claim 1 wherein said step of coating at least some of the cell walls with an adhesive is accomplished by coating the cell walls with a material selected from the group consisting essentially of beeswax, carnauba wax, montan wax, paraffin wax, a fatty acid, and a fatty acid ester.

3. A process as recited in claim 2 wherein said step of coating the cell walls is practiced so as to coat the whole wall surface of all the cells with adhesive and inoculant.

4. A filter for filtering molten iron comprising:

a body of open-cell ceramic foam;

a layer of an adhesive material in contact with at least some of the cells of said open-cell ceramic foam, and at least partially coating and cell walls, said adhesive selected from the group consisting essentially of wax and substances having the physical characteristics of wax; and a layer of inoculant for the molten iron disposed on top of said adhesive layer so that said adhesive layer is between said inoculant and the cell walls of said open-cell ceramic foam.

5. A filter as recited in claim 4 wherein said inoculant is selected from the group consisting essentially of graphite, calcium silicide, and ferrosilicon.

6. A filter as recited in claim 5 wherein said ferrosilicon contains a material selected from the group consisting essentially of aluminum, titanium, chromium, zirconium, manganese, copper, bismuth, an alkaline earth, a rare earth, and combinations of one or more of aluminum, titanium, chromium zirconium, manganese, copper, bismuth, an alkaline earth, and a rare earth.

7. A filter as recited in claim 5 wherein said ferrosilicon is mixed with a material selected from the group consisting essentially of aluminum, titanium, chromium, zirconium, manganese, copper, bismuth, an alkaline earth, a rare earth, and combinations of one or more of aluminum, titanium chromium, zirconium, manganese, copper, bismuth an alkaline earth and a rare earth.

8. A filter as recited in claim 4 wherein the inoculant is ferrosilicon, and further comprising a layer on top of said ferrosilicon, said layer on top of said ferrosilicon selected from the group consisting essentially of aluminum, titanium, chromium, zirconium, manganese, copper, bismuth, an alkaline earth, a rare earth, and combinations of one or more of aluminum, titanium, chromium, zirconium, manganese, copper, bismuth, an alkaline earth, and a rare earth.

9. A filter as recited in claim 4 wherein the inoculant has a particle size of up to 10 mm.

10. A filter as recited in claim 4 wherein the inoculant has a particle size of 0.05–2 mm.

11. A filter as recited in claim 4 wherein the adhesive is selected from the group consisting essentially of beeswax, carnauba wax, montan wax, paraffin wax, fatty acids, and fatty acid esters.

12. A filter as recited in claim 11 wherein the adhesive coats the whole wall surface of all cells of said filter, and inoculant is provided over the whole wall surface too.

13. A filter as recited in claim 4 wherein the adhesive coats the whole wall surface of all cells of said filter, and inoculant is provided over the whole wall surface too.

14. A filter as recited in claim 4 wherein said adhesive is selected from the group consisting essentially of beeswax, carnauba wax, montan wax, and paraffin wax.

* * * * *